United States Patent [19]

Finch

[11] 4,244,258

[45] Jan. 13, 1981

[54] RHYTHM SYSTEM FOR ELECTRONIC ORGAN

[75] Inventor: Robert A. Finch, Mundelein, Ill.

[73] Assignee: CBS Inc., New York, N.Y.

[21] Appl. No.: 65,479

[22] Filed: Aug. 10, 1979

[51] Int. Cl.[3] ..... G10F 1/00

[52] U.S. Cl. ..... 84/1.03; 84/DIG. 12; 84/DIG. 2

[58] Field of Search ..... 84/1.03, DIG. 2, DIG. 12

[56] References Cited

U.S. PATENT DOCUMENTS

| | | | |
|---|---|---|---|
| 3,649,736 | 3/1972 | Van der Koon | 84/1.03 |
| 4,154,132 | 5/1979 | Mishima | 84/1.03 |

*Primary Examiner*—Gene Z. Rubinson
*Assistant Examiner*—Forester W. Isen
*Attorney, Agent, or Firm*—Spencer E. Olson

[57] ABSTRACT

An automatic rhythm system for an electronic organ adapted to enable a plurality of percussive instruments and a plurality of accompaniment and "Walking Bass" instruments normally played by the pedals of the organ includes two separate rhythm pattern generators each storing a plurality of rhythm patterns, the outputs from one of which enables selected percussive instruments and the outputs from the other enabling little used percussive instruments and the "Walking Bass" normally played by the pedals. A plurality of rhythm select switches are directly connected to respective input terminals of the first rhythm pattern generator, and to ensure against generation of musically unacceptable combinations of rhythm patterns when a combination of rhythm patterns is selected, the rhythm select switches are connected through control logic to the second rhythm pattern generator, the control causing the second rhythm pattern generator to play only the first turned on rhythm pattern of a combination of patterns. That is, the sequence in which the rhythm patterns of a combination are turned on determines which singular pedal pattern will play with that combination of rhythm patterns.

9 Claims, 2 Drawing Figures

RHYTHM SYSTEM FOR ELECTRONIC ORGAN

BACKGROUND OF THE INVENTION

The present invention relates to a rhythm unit employed in association with an electronic organ or the like, and more particularly, to a rhythm unit having a control system that enables the opertor to determine which one of a combination of simultaneously played rhythm patterns will be played as the pedal pattern.

It is conventional in electronic organs to provide a rhythm unit in the form of a repetitively operating pulse generator or the like, for continuously producing series of timed pulses in repetitive cycles. The heart of a typical rhythm system is a read only memory, or ROM, which has a plurality of input terminals connected individually to a like plurality of rhythm select switches and under control of a clock produces a series of pulses on an output line which are spaced to define the rhythm selected by the rhythm select switches. The commercially availabe Type M253 ROM typically used in rhythm units is a mask programmable ROM having twelve input terminals and eight output terminals (in addition to a clock terminal and the normal voltage terminals) and is capable of storing twelve different rhythm patterns. A source of clock pulses is connected to the clock terminal and when any of the input terminals is grounded by actuation of the corresponding rhythm select switch a rhythm pattern determined by the contents of the ROM appears as an 8-bit word on the output terminals. The eight bits of each word may correspond to eight percussive rhythm instruments such as bass drum, snare drum, cymbal, etc. Although there is seldom need for more than twelve rhythm patterns, it frequently is desirable to provide more than eight percussive rhythm instruments; heretofore this objective has been achieved by utilizing two such ROM's, connecting the twelve rhythm select switches in parallel to corresponding input lines of the two ROMs, and controlling them with a common clock thereby to provide twelve possible patterns on sixteen instrument output lines. Applicant's assignee uses this arrangement in certain of its current organ models, utilizing the sixteen available output lines to feed up to sixteen instruments, including the "Walking Bass" outputs and accompaniment rhythms, in addition to a variety of percussive instruments. With this arrangement, when two or more rhythm patterns are on, the outputs from both ROMs "OR". Whenever there is a bass drum beat, for example, in either of the on rhythm patterns, it will also appear in the "new" combination pattern. This is acceptable, and in many cases quite useful, in the case of percussive rhythm instruments because it enables derivation of new patterns having certain characteristics of the selected patterns. However, the arrangement is not without its disadvantages. Not only do the normal rhythm patterns combine when two or more rhythm patterns are selected, but the accompaniment rhythm patterns and the "Walking Bass" pattern also combine which sometimes results in patterns that are not musically correct for either of the rhythm patterns, and the accompaniment rhythm pattern turns out to have a pattern with too many beats, one that is too busy.

Competitors of applicant's assignee have partially overcome this disadvantage by establishing a sequence of patterns left to right such that for any combination of selected rhythm patterns only the one to the left or to the right, as displayed on the rhythm select switches, will play. This solution, however, limits operation to a predetermined set of conditions so that if, for example, three rhythm patterns are turned on, the rhythm instruments may or may not sum but the pedal or "Walking Bass" patterns will be predetermined to be the farthest left in that group of three patterns; that is, only when the farthest left rhythm select switch is on can the "Walking Bass" pattern be obtained.

SUMMARY OF THE INVENTION

It is, therefore, a primary object of the present invention to provide an improved rhythm unit for an electronic organ or the like which obviates the foregoing disadvantages of prior art rhythm units.

Briefly, an illustrative embodiment of the improved rhythm unit, like the prior art unit, utilizes two ROMs each having twelve input lines and eight output terminals, the first of which contains the pattern information for twelve rhythm patterns and whose output terminals are connected to drive eight different percussive rhythm instruments, and the second ROM contains "Walking Bass" and accompaniment rhythm pattern information, and in one embodiment drives at two of its output terminals infrequently used percussive rhythm instruments, namely, the clave and woodblock. The twelve rhythm select switches are directly connected to respective input terminals of the first ROM and through a logic circuit to the input terminals of the second ROM, the logic circuit causing the second ROM to play only the first one turned on of two or more rhythms selected by the rhythm select switches. This enables the player to select any combination of rhythm patterns and by the sequence in which the rhythm select switches are selected, to determine which singular pedal pattern will play with that combination of rhythm patterns. For example, if three rhythm patterns are selected, all three will be OR'd to provide a combination of rhythm patterns, but only the first pattern selected will provide the pedal pattern.

DESCRIPTION OF THE DRAWINGS

Other objects, features and advantages of the invention will become apparent, and its construction and operation better understood, from the following detailed description, read in conjunction with the accompanying drawings, in which.

DESCRIPTION OF THE PREFERRED EMBODIMENT

Figure 1:
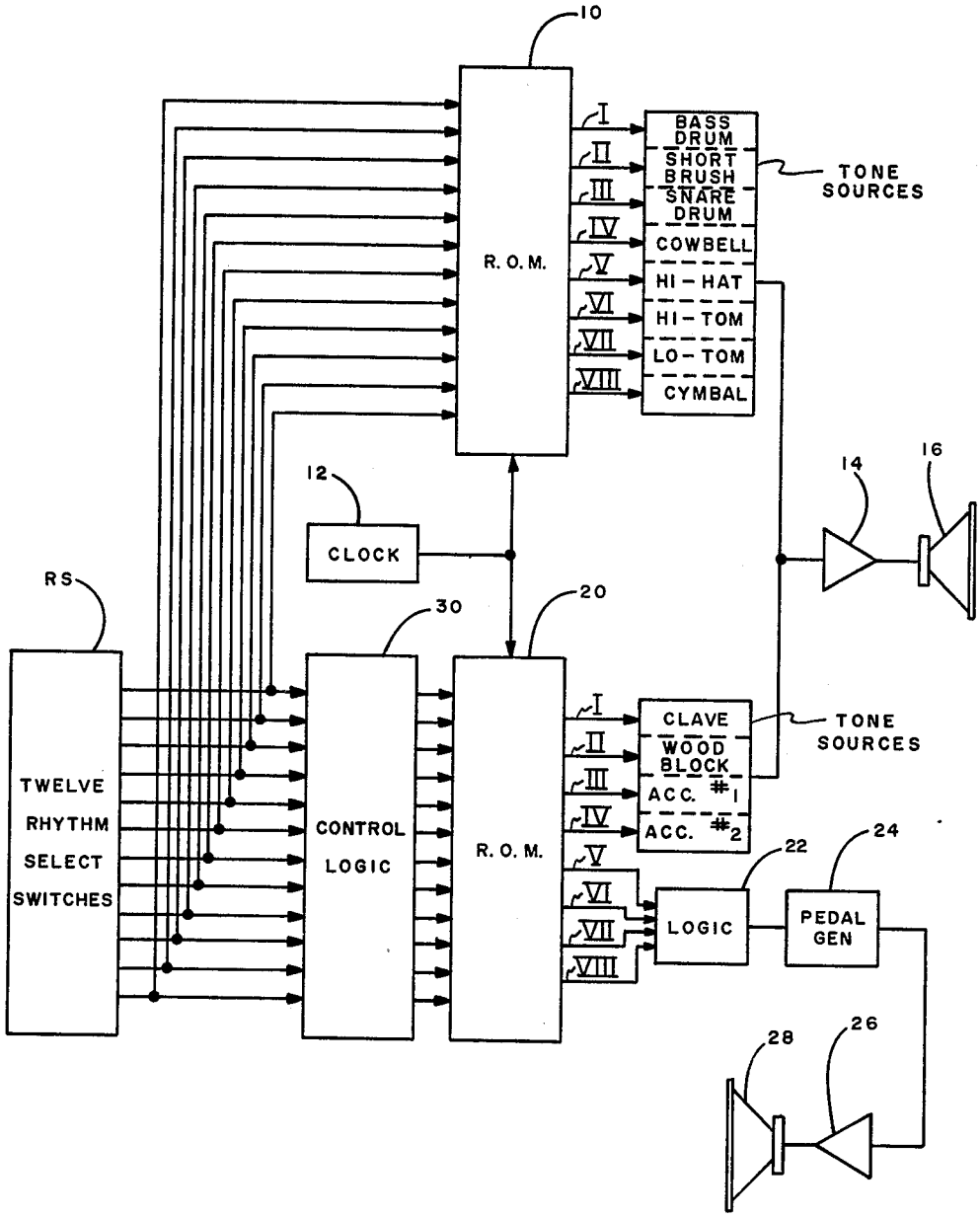
FIG. 1 is a block diagram of a rhythm unit embodying the present invention.

Referring first to FIG. 1, a functional block diagram of a portion of an electronic organ incorporating an exemplary embodiment of the present invention is illustrated. Twelve automatic rhythms are provided and selected by a set of twelve rhythm select switches RS, which may be a set of twelve push-buttons, or rocker tabs or any of several other types of on-off switches known to the electronic organ art. Selecting any given rhythm automatically programs the correct rhythms, percussive and accompaniment voices for that rhythm. An MOS programmable ROM 10, such as the type M253 available from SGS, is used to store twelve rhythm patterns and is controlled by a rhythm clock 12.

Eight instrument trigger pulse outputs on leads I–VIII are provided by the ROM 10 which trigger percussive instruments employed in the rhythms. Output line 1 is used to trigger the bass drum, II the short brush, III the snare drum, IV the cowbell, V the hi-hat, VI the HI TOM, VII the LO TOM and VIII the cymbal. The outputs of these tone sources are fed to an output amplifier 14 and loudspeaker 16.

A second ROM 20 of the same type as ROM 10 is used to store "Walking Bass" pattern information and accompaniment rhythm pattern information and two infrequently used rhythm patterns for two additional percussive voices. Output line I of ROM 20 is used to trigger the clave, II the wood block, III a first accompaniment rhythm pattern, IV a second accompaniment rhythm pattern, and the other four output lines provide a 4-bit binary output representing notes of a musical scale which is decoded in a logic network 22 to generate enabling pulses for a pedal generator 24, which may be of the configuration shown in Schmoll U.S. Pat. No. 4,127,048, which generates the "Walking Bass" sound pattern. The outputs of the clave, wood block, and accompaniment Nos. I and II are fed to amplifier 14 and loudspeaker 16, and the output of pedal generator 24 preferably is reproduced in a separate reproducing channel including an amplifier 26 and loudspeaker 28.

The inputs of the two ROM's 10 and 20 are effectively activated in parallel by selective actuation of the rhythm select switches RS, except that in the case of ROM 20 a logic circuit 30 is interposed between the rhythm select switches and the inputs to the ROM, the function of which is to cause ROM 20 to play only the first turned on of two or more rhythm patterns selected by switches RS. For example, if three rhythms are selected a combination of these three will be produced, but only the first turned on of the three rhythm select switches will determine the pedal pattern. Any one of the three patterns in the combination can be selected for the pedal pattern, simply by turning it on first. There are as many different pedal patterns available as there are elements in the combination; for example, if a waltz pattern and a rumba pattern are played together, the resulting rhythm pattern is a sort of three-quarter tempo or Latin rhythm, and either the waltz or the rumba pattern can be applied to the pedal, depending on which is turned on first. Thus, the instrumentalist can determine for himself which pattern he will get.

Figure 2:
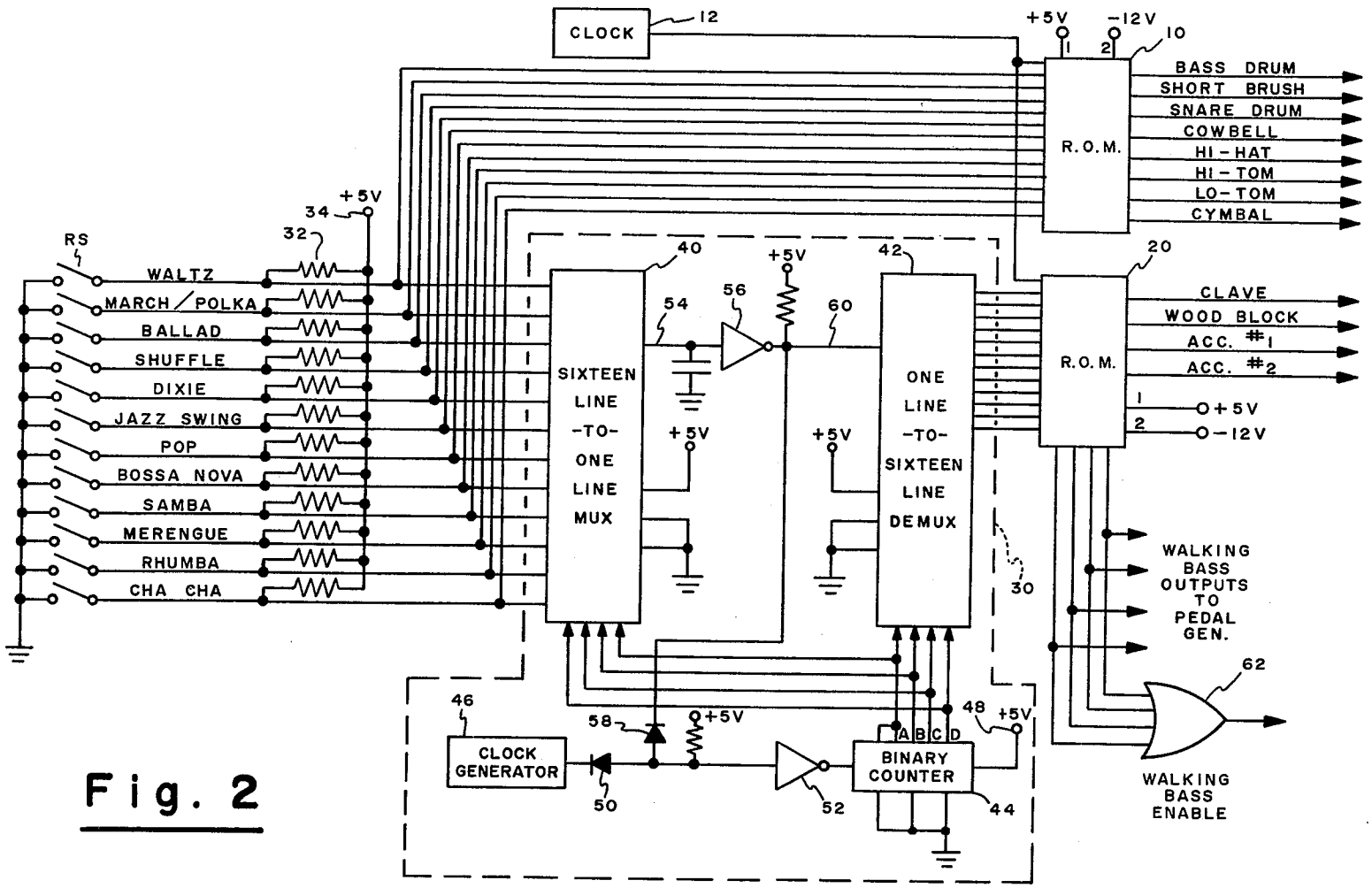
FIG. 2 is a system diagram, partly schematic and partly in block diagram form, of a preferred form of rhythm unit according to the invention.

Turning now to FIG. 2 in which the rhythm unit functionally described in connection with FIG. 1 is shown in more detail, and like reference numerals are used to identify like components, twelve rhythm select switches RS, one contact of each of which is connected to ground, are operative when closed to respectively select waltz, march/polka, ballad, shuffle, Dixie, jazz swing, pop, Bosa Nova, samba, merengue, rhumba and cha-cha rhythm patterns. The other contact of each of the switches is connected through a resistor 32, typically having a value of 10 Kohms, to a source of +5 volts, represented by terminal 34, and also to a respective one of twelve inputs to logic circuit 30. The potential source 34 and the resistor associated with each switch establish a "high" voltage level at the corresponding input terminals of ROM 10, and at the twelve inputs to control logic 30, when the switches RS are open. When a rhythm select switch is closed, the respective one of the twelve input terminals of ROM 10 that is "low" is applied to the selected input terminal. As has been noted earlier, ROM 10 may be a Type M253 mask programmable ROM, in which the twelve named rhythm patterns are stored.

The "low" produced by actuation of a rhythm select switch is also applied to a respective input to logic circuit 30 which, in the illustrated embodiment, comprises a multiplexer 40, a demultiplexer 42, a binary counter 44 and a clock generator 46 interconnected as shown. The multiplexer 40 may be a Type 74150 sixteen line-to-one multiplexer commercially available in integrated circuit form from several manufacturers, twelve of the input lines of which are connected one each to a respective rhythm select switch. The multiplexer 40 is fed a 4-bit address from binary counter 44, which may be a conventional sixteen count binary counter energized from a +5 volts source, represented by terminal 48, and having four outputs A, B, C and D. Counter 44 is driven by a clock generator 46 having a fast clock rate, of the order of 50 KHz, which frequency is not critical. The generator 46 produces negative-going pulses which are coupled to the counter via a diode 50 and an inverting amplifier 52, such that positive-going clock pulses are applied to the counter. The continuously running clock generator together with the binary counter 44 cyclically applies sixteen different binary addresses to the multiplexer, one for each of the sixteen input lines (only twelve of which are used in this application), and when there is coincidence between a "low" on a particular input line and the address for that input line, an output signal, which is the inverse of the input signal, is produced on the single output line 54 of multiplexer 40. That is, the "low" at an input terminal caused when the corresponding rhythm select switch is grounded appears as a "high" on output line 54. Assuming, by way of example, that the address of the input line to which the waltz rhythm select switch is connected is count No. 1, and the waltz switch only is actuated, when the 4-bit binary output of counter 44 corresponds to count No. 1 the "low" at the input line is transferred as a "high" to the output line 54. The resulting "high" is applied to and inverted by an inverting gate 56, and the "low" output therefrom is applied via a diode 58 to the input of inverting amplifier 52, thereby to disable the clock pulses being fed to binary counter 44 and causing the multiplexer to retain the "high" at output line 54 so long as the waltz switch is closed. Rhythm select switches other than the waltz can thereafter be closed, and will be effective to select the respective rhythm pattern in ROM 10, but since the count of multiplexer 40 cannot continue by virtue of its disablement by actuation of the waltz switch, closure of additional rhythm select switches have no effect on ROM 20.

The "low" at the output of inverting gate 56 is applied to the one-line input of a demultiplexer 42, which may be a commercially available Type 74154 one line-to-sixteen line demultiplexer, which is also driven by binary counter 44 so as to be clocked to the same position as multiplexer 40, The demultiplexer does not, however, invert the input signal so that the "low" at the input appears on the first output line of the demultiplexer which, in turn, is applied to the input line of ROM 20 which selects the waltz rhythm pattern stored therein. Thus, actuation of the waltz rhythm select switch causes both of ROM's 10 and 20 to produce the same pattern and the outputs of the two ROM's will be the same as if the inputs of ROM 20 were connected in parallel with the inputs to ROM 10.

If, now, a second pattern, say the shuffle, is selected in addition to the waltz pattern, a "low" is directly applied to the input terminal of ROM 10 which corresponds to the shuffle pattern with the result that the output from ROM 10 will be the OR'd combination of the waltz and shuffle patterns. Nothing will happen, however, at ROM 20 because multiplexer 40 is stopped in the position at which only the waltz pattern stored in ROM 20 can be enabled. This means that the pedal pattern produced by ROM 20 will be the one for the waltz regardless of how many additional rhythm select switches are turned on.

Now, if the waltz switch is turned off while keeping the shuffle switch on, the "low" disabling the clock to binary counter 44 will be removed and the multiplexer will again scan in numerical sequence from one through sixteen to the next "low" input line, in this example, the "shuffle", whereupon the clock applied to binary counter 44 will again be disabled. This produces a "low" on the output line of demultiplexer 42 that is connected to the shuffle-enable input of ROM 20, thereby selecting a pedal pattern determined for the shuffle.

If, now, the waltz switch is turned back on, there will again be a combination of waltz and shuffle patterns produced by ROM 10, but because multiplexer 40 has stopped counting by virtue of the earlier actuation of the shuffle rhythm select switch, ROM 20 will continue to produce the shuffle pedal pattern.

It will now be evident that all twelve of the rhythm select switches could be on simultaneously, with ROM 10 producing a rhythm pattern (which may or may not be useful) consisting of a combination of all twelve patterns, with the pedal pattern determined by only the first one of the rhythm select switches that was turned on. Should it be desired to change the pedal pattern, the instrumentalist simply turns off the switch that was originally turned on first, whereupon multiplexer 40 automatically selects as the pedal pattern that rhythm pattern associated with the input line next in numerical sequence. To illustrate, if the instrumentalist wishes to play three patterns together, he can by turning on in proper order the switches for those patterns select as the pedal pattern that one of the three which will be correct for the combination. Thus, unlike older organ systems in which the "Walking Bass" was totally independent of the rhythm unit and presented the risk of playing a "Walking Bass" pattern that did not fit the rhythm pattern automatically played by the rhythm unit, in the present system the "Walking Bass" is tied directly into the rhythm unit to ensure that the "Walking Bass" pattern selected is correct for the selected combination of automatic rhythm patterns. As was indicated earlier, this is achieved by storing "Walking Bass" rhythm pattern information in ROM 20 which is programmed to produce at four output terminals thereof output signals for application to a pedal generator (not shown) in response to triggering of ROM 20 by actuation of the rhythm select switches for certain ones of the twelve available automatic rhythm patterns. By way of example, the pedal tone generator may be of the type described in commonly assigned U.S. Pat. No. 4,127,048 dated Nov. 28, 1978. A signal for enabling the "Walking Bass" is derived from the four "Walking Bass" outputs by applying them to a 4-input OR gate 62.

It will be seen from the foregoing description that there is provided a relatively inexpensive automatic rhythm unit which enables the instrumentalist, when selecting combinations of automatic rhythm patterns, to ensure that the pedal pattern played as a result of the selection will be compatible with the automatically played rhythm patterns, and also permits easy change from one singular pedal pattern to another. This important advantage is achieved by the logic circuit 30 consisting of a pair of relatively inexpensive inverting gates 52 and 56, a clock generator 46 the frequency of which is not critical, a standard commercially available binary counter 44, and the multiplexer 40 and demultiplexer 42, both commercially available in integrated circuit chip form at modest cost.

While the invention has been disclosed by means of a specific illustrative embodiment thereof, it will be obvious to those skilled in the art that various modifications can be made without departing from the spirit of the invention as defined in the appended claims. For example, although ROM's each adapted to store rhythm pattern information for twelve different rhythms are employed in the illustrated embodiment, the principle of the invention is equally applicable to rhythm units utilizing ROM's having lesser or greater pattern storage capacities. Also, although a specific form of logic circuit is described for causing ROM 20 to be triggered only in response to the first turned on of a plurality of rhythm select switches, other implementations for achieving this function will now be suggested to ones skilled in the art.

I claim:

1. An automatic pulse pattern generating unit for an electronic organ having percussive and accompaniment voices, comprising:

a set of switches each for selecting when actuated one of a multiplicity of different pulse patterns, first means including first memory means storing a first set of two or more pulse patterns and responsive to actuation of two or more of said switches for producing a pulse pattern of percussive voices consisting of an "OR"d combination of two or more pulse patterns of said first set corresponding to the actuated switches, and second means including second memory means storing a second set of two or more pulse patterns different from the pulse patterns of said first set for producing in response to actuation of said two or more switches a singular pulse pattern of said second set of an accompaniment voice corresponding to the first actuated of said two or more switches.

2. Apparatus according to claim 1, wherein said first means comprises first read only memory means having input terminals each connected to a respective one of said switches and a plurality of output terminals, clock means for applying clock pulses to said first read only memory means, and means for deriving from the output terminals of said first read only memory means two or more pulse patterns of said first set correspond ıg to the actuated switches; and wherein said second means comprises second read only memory means connected to said clock means to be driven in synchronism with said first read only memory means and having input and output terminals, means for deriving from the output terminals of said second read only memory means a selected one of the said two or more pulse patterns stored therein in response only to selective enablement of a single one of the input terminals thereof, and logic circuit means having input terminals each connected to a respective one of said switches and output terminals each connected to a respective one of the input terminals of said second read only memory means for enabling a single input terminal of said second memory means in response to the first actuated of said two or more switches.

3. Apparatus according to claim 2, wherein said first and second read only memory means are solid state mask programmed read only memories.

4. An automatic rhythm unit for an electronic organ having percussive and accompaniment voices, comprising:

a set of rhythm select switches each for selecting when activated one of a multiplicity of different rhythm patterns, first means including first memory means operatively connected to said switches and storing a first set of two or more rhythm patterns and operative in response to actuation of two or more of said rhythm select switches to produce a rhythm pattern of percussive voices consisting of the "OR"d combination of two or more rhythm patterns corresponding to the actuated switches, and second means including second memory means operatively connected to said switches and storing a second set of two or more rhythm patterns different from the rhythm patterns of said first set and operative in response to actuation of said two or more rhythm select switches to produce a singular pedal rhythm pattern of an accompaniment voice corresponding to the first actuated of said two or more rhythm select switches.

5. An automatic rhythm unit according to claim 4, wherein said first means comprises first read only memory means having a plurality of input terminals each connected to a respective one of said rhythm select switches and a plurality of output terminals, clock means for applying clock pulses thereto, and means for deriving from the output terminals of said first read only memory means two or more rhythm patterns of said first set corresponding to the actuated rhythm select switches; and wherein said second means comprises second read only memory means connected to be driven by said clock means in synchronism with said first read only memory means and having a plurality of input terminals and a plurality of output terminals, means for deriving from the output terminals of said second read only memory means only one of the said rhythm patterns stored therein in response to selective enablement of a single one of the input terminals thereof, and logic circuit means having input terminals each connected to a respective one of said rhythm select switches and a plurality of output terminals each connected to a respective one of the input terminals of said second read only memory means for selectively enabling a single input terminal of said second memory means in response to only the first actuated of said two or more rhythm select switches.

6. Apparatus according to claim 5, wherein said first and second read only memory means are solid state mask programmed read only memories.

7. An automatic rhythm unit for electronic organ, comprising:

a set of rhythm select switches each for selecting when actuated one of a multiplicity of different rhythm patterns, and two or more memory means each storing two or more rhythm patterns and each operatively connected to said rhythm select switches, at least one of said memory means being operative in response only to the first actuated when two or more of said switches are actuated in sequence to produce a single rhythm pattern corresponding to said first actuated switch.

8. An automatic rhythm unit for an electronic organ, comprising:

a set of rhythm select switches each for selecting when actuated one of a multiplicity of different rhythm patterns, first and second memory means respectively storing first and second sets of different rhythm patterns and each operatively connected to said rhythm select switches.

said first memory means being operative in response to actuation of two or more of said switches to produce a rhythm pattern consisting of the combination of the two or more rhythm patterns of said first set corresponding to the actuated switches, and the operative connection of said second memory means to said rhythm select switches including logic circuit means for causing said second memory means to be responsive only to the first actuated when two or more of said switches are actuated in sequence to produce a single rhythm pattern of said second set corresponding to said first actuated switch.

9. Apparatus according to claim 8, wherein said second memory means has a plurality of input terminals and a plurality of output terminals and is operative to produce at its output terminals one of the said rhythm patterns stored therein in response to selective enablement of a single one of the input terminals thereof, and wherein said logic circuit means has input terminals each connected to a respective one of said rhythm select switches and output terminals each connected to a respective one of the input terminals of said second memory means and is operative to selectively enable a single input terminal of said second memory means in response to only the first actuated of said two or more rhythm select switches.

* * * * *